US010779588B2

(12) United States Patent
Hazani

(10) Patent No.: US 10,779,588 B2
(45) Date of Patent: Sep. 22, 2020

(54) WRIST PROTECTION AND SUPPORT MECHANISM

(71) Applicant: Idan Hazani, Haifa (IL)

(72) Inventor: Idan Hazani, Haifa (IL)

( * ) Notice: Subject to any disclaimer, the term of this patent is extended or adjusted under 35 U.S.C. 154(b) by 0 days.

(21) Appl. No.: 14/726,619

(22) Filed: Jun. 1, 2015

(65) Prior Publication Data

US 2015/0257462 A1 Sep. 17, 2015

Related U.S. Application Data

(63) Continuation of application No. 13/124,459, filed as application No. PCT/IB2009/054769 on Oct. 28, 2009, now abandoned.

(60) Provisional application No. 61/109,076, filed on Oct. 28, 2008.

(51) Int. Cl.

| | |
|---|---|
| ***A41D 19/00*** | (2006.01) |
| ***A41D 20/00*** | (2006.01) |
| ***A41D 13/08*** | (2006.01) |
| ***A41D 13/06*** | (2006.01) |
| ***A41F 1/00*** | (2006.01) |
| ***A63B 71/14*** | (2006.01) |
| ***A41F 1/06*** | (2006.01) |

(52) U.S. Cl.

CPC ..... *A41D 13/088* (2013.01); *A41D 13/065* (2013.01); *A41D 13/08* (2013.01); *A41D 19/0044* (2013.01); *A41D 20/00* (2013.01); *A41F 1/06* (2013.01); *A63B 71/14* (2013.01); *A63B 71/143* (2013.01); *A63B 71/146* (2013.01)

(58) Field of Classification Search

CPC .... A41D 13/088; A41D 13/08; A41D 13/065; A41D 19/0044; A41D 20/00; A41F 1/06; A63B 71/14; A63B 71/143; A63B 71/146

USPC ..... 2/16, 162, 170, 910, 917

See application file for complete search history.

(56) References Cited

U.S. PATENT DOCUMENTS

| | | | | |
|---|---|---|---|---|
| 3,410,023 A * | 11/1968 | Anello | A63H 33/00 446/353 |
| 4,724,548 A * | 2/1988 | London | A41F 9/002 2/170 |
| 4,748,975 A | 6/1988 | Yashima | |
| 4,973,176 A | 11/1990 | Dietrich | |
| 5,404,591 A * | 4/1995 | Brinnand | A41D 13/088 2/161.1 |

(Continued)

FOREIGN PATENT DOCUMENTS

| | | |
|---|---|---|
| EP | 0779068 A1 | 11/1997 |
| GB | 2478663 B | 11/2013 |

OTHER PUBLICATIONS

Summary of Relevance in English of First office Action from Israel Patent Office to Letter dated Jul. 29, 2013 App No. 212513.

(Continued)

*Primary Examiner* — Clinton T Ostrup
*Assistant Examiner* — Cameron A Carter
(74) *Attorney, Agent, or Firm* — Mark M. Friedman

(57) ABSTRACT

A wrist of a person may be supported as the person operates equipment over a flat work surface by using an article of manufacture having only a sheet and a plurality of protrusions extending from the sheet by placing the article of manufacture as a flat mat for placement on the flat work surface or by wearing the article of manufacture as a wristband.

21 Claims, 10 Drawing Sheets

(56) References Cited

U.S. PATENT DOCUMENTS 5,418,980 A * 5/1995 Kelly ..... A41D 20/00 2/16
5,468,220 A * 11/1995 Sucher ..... A61F 5/05866 2/170
5,557,803 A * 9/1996 Granich ..... A41D 19/01523 2/16
5,566,913 A * 10/1996 Prokop ..... A47B 21/0371 248/118
5,738,398 A * 4/1998 Miano ..... A44B 18/00 24/442
5,745,920 A * 5/1998 Olivier ..... A63B 21/4021 2/161.1
5,810,753 A 9/1998 Eberbach
5,857,217 A * 1/1999 Hsueh ..... A44C 5/0007 2/170
6,006,751 A * 12/1999 Spitzer ..... A61F 5/0118 128/878
6,116,251 A * 9/2000 Stachowski ..... A45D 8/34 132/273
6,499,703 B2 * 12/2002 Chou ..... A47B 21/0371 248/118
7,025,310 B2 4/2006 Bouchard
7,073,202 B1 * 7/2006 Geary ..... A41D 13/088 2/16
D552,804 S * 10/2007 Sun ..... D30/152
D568,198 S * 5/2008 Pilkin ..... D11/6
2002/0157163 A1 * 10/2002 Chen ..... G06F 3/039 2/16
2003/0028136 A1 * 2/2003 Stager ..... A47B 21/0371 602/21
2006/0226305 A1 * 10/2006 Sheybani ..... A61F 5/0118 248/118.5
2009/0205106 A1 * 8/2009 Sohn ..... A41D 20/00 2/170

OTHER PUBLICATIONS

Notification of Grant, UK Patent Office, GB2478663, dated Oct. 8, 2013, App No. GB1106222.1.
Letter of Report of Telephone conversation, UK Patent Office, dated Dec. 18, 2012, GB1106222.1.
PCT, International Search Report and Written Opinion, PCT/IB09/54769, dated Feb. 12, 2010.
3rd Examination Report, UK Patent office, dated May 13, 2013, GB1106222.1.
4th Examination Report, UK Patent office, dated Aug. 12, 2013, GB1106222.1.
2nd Examination Report, UK Patent office, dated Feb. 20, 2013, GB1106222.1.
Israel Patent Office, First Office Action Letter, App No. 212513, dated Jul. 29, 2013.
1st Examination Report, UK Patent office, dated Nov. 6, 2012, GB1106222.1.

* cited by examiner

WRIST PROTECTION AND SUPPORT MECHANISM

CROSS REFERENCE TO RELATED APPLICATIONS

The present application is a continuation application of application Ser. No. 13/124,459 filed 2011 Apr. 15 which is a national phase application of PCT/IB09/054769 filed 2009 Oct. 28 which benefits priority from U.S. 61/109,076 filed 2008 Oct. 28.

FIELD AND BACKGROUND

Carpal tunnel syndrome occurs when the median nerve, which runs from the forearm into the hand, becomes pressed or squeezed at the wrist. The median nerve controls sensations to the palm side of the thumb and fingers, as well as impulses to some small muscles in the hand that allow the fingers and thumb to move. The carpal tunnel, a narrow, rigid passageway of ligament and bones at the base of the hand houses the median nerve and tendons. Sometimes, thickening from irritated tendons or other swelling narrows the tunnel and causes the median nerve to be compressed. The result may be pain, weakness, or numbness in the hand and wrist, radiating up the arm. At the workplace, workers can do on-the-job conditioning, perform stretching exercises, take frequent rest breaks, wear splints to keep wrists straight, and use correct posture and wrist position. Wearing fingerless gloves can help keep hands warm and flexible. Workstations, tools and tool handles, and tasks can be redesigned to enable the worker's wrist to maintain a natural position during work. Employers can develop programs in ergonomics, the process of adapting workplace conditions and job demands to the capabilities of workers.

Splints are safe and relatively inexpensive, and they give many people with carpal tunnel syndrome and other orthopedic problems short-term relief from their symptoms. Besides relieving discomfort, splints can sometimes improve conduction of nerve impulses along the median nerve, which can improve strength, dexterity and sensation. A number of designs for wrist supports are disclosed in U.S. Pat. No. 6,694,519 (Stewart) "Device and method for supporting the wrist and hand of a computer user", U.S. Pat. No. 6,517,507 (Faherty) "Wrist guard for alleviating repetitive strain disorder by computer operators", and US 2006/0226305 (Sheybani) "Wristband for keyboards and mouse use".

Rubber elasticity, also known as hyper elasticity, describes the mechanical behavior of many polymers, especially those with cross linking. Invoking the theory of rubber elasticity, one considers a polymer chain in a cross linked network as an entropic spring. When the chain is stretched, the entropy is reduced by a large margin because there are fewer conformations available. Therefore, there is a restoring force, which causes the polymer chain to return to its equilibrium or unstretched state, such as a high entropy random coil configuration, once the external force is removed. This is the reason why rubber bands return to their original state.

Silicone rubber is a polymer that has a "backbone" of silicon-oxygen linkages, the same bond that is found in quartz, glass and sand. Normally, heat is required to set the silicone rubber. Silicone rubber articles are typically injection molded.

BRIEF SUMMARY

Various methods are provided herein to support a wrist of a person while the person is operating equipment over a flat surface by providing a sheet with a plurality of elastic protrusions attached to and extending from the sheet. The sheet may be placed as a flat mat on the flat work surface with the protrusions are oriented downward to contact the flat work surface or the sheet is worn as a band on the wrist. The sheet may be removed from the flat work surface and then worn as a band on the wrist. While wearing the sheet as a band on the wrist the protrusions oriented toward the wrist or toward the flat work surface. Ends of the band may be connected together with a fastening device. The heights of the elastic protrusions may vary monotonically along one or more lateral directions according to the angle and/or contour of the wrist for said flat mat and/or said band. The heights of the elastic protrusions may vary periodically and/or lateral dimensions of the elastic protrusions along one or more lateral directions may vary responsive to a varying cross section of the elastic protrusions. A wrist of a person may be supported as the person operates equipment over a flat work surface by using an article of manufacture having only a sheet and a plurality of protrusions extending from the sheet by placing the article of manufacture as a flat mat for placement on the flat work surface or by wearing the article of manufacture as a wristband.

According to the present invention there is provided an article of manufacture for protecting a wrist of a person as the person operates equipment over a work surface. The article of manufacture includes a sheet and multiple protrusions attached to and extending from the sheet. The sheet may be placed on the work surface and the protrusions are vertically oriented and adapted to provide support of the wrist. The sheet and protrusions may be manufactured in a single manufacturing process, e.g casting or injection molding. Alternatively, the sheet may and the protrusions may be of different materials typically with the sheet a stiffer material than that of the protrusions. The protrusions may have a lateral dimension, e.g. diameter of between 2 and 10 millimeters. The protrusions typically have a number density on the sheet between half and ten per square centimeter. In use, the protrusions provide support of the wrist. The sheet may include a woven textile matrix or a synthetic textile matrix. The protrusions may be made from an elastic material, such as by polymerizing an elastomeric resin. The protrusions may be made from selectably either silicone rubber, latex rubber or natural rubber or other elastomeric material. The sheet is optionally manufactured from a non-flexible material, an elastic material or a semi-rigid material. Two edges of the sheet may include fasteners allowing the article of manufacture to be worn as a band on the wrist. When the article is used as a mat on the work surface, the protrusions may be oriented upward toward the wrist or downward toward the work surface. Optionally, the height of the protrusions are graded along the length of the mat in order to provide the user with an adjustable height. Alternatively or in addition the height of the protrusions varies along the width of the mat in order to conform to the angle of the wrist to the work surface.

According to the present invention there is provided an article of manufacture for protection a wrist of a person as the person operates equipment over a work surface. The article of manufacture includes a sheet with protrusions. The protrusions provide support of the wrist. The article of manufacture may function as either a mat for placement on the work surface or as a wristband both for the protection of the wrist. The sheet and protrusions may be manufactured in a single casting such as from a polymer resin which polymerizes into an elastic or resilient material. A wristband closure, e.g. buckle or snap is typically attached after the casting.

According to the present invention there is provided a wristband of substantially elliptical cross-section in the plane of the wristband. The wristband functions to support a wrist of a person as the person operates equipment over a work surface. The wristband has multiple protrusions extending either inward or outward from the band. The sheet and protrusions may be manufactured as a single casting. The protrusions typically have a lateral dimension, e.g. diameter, of between two and ten millimeters and a number density on said sheet between half and ten per square centimeter.

The foregoing and/or other aspects will become apparent from the following detailed description when considered in conjunction with the accompanying drawing figures.

BRIEF DESCRIPTION OF THE DRAWINGS

The invention is herein described, by way of example only, with reference to the accompanying drawings, wherein.

DETAILED DESCRIPTION

Figure 1A:
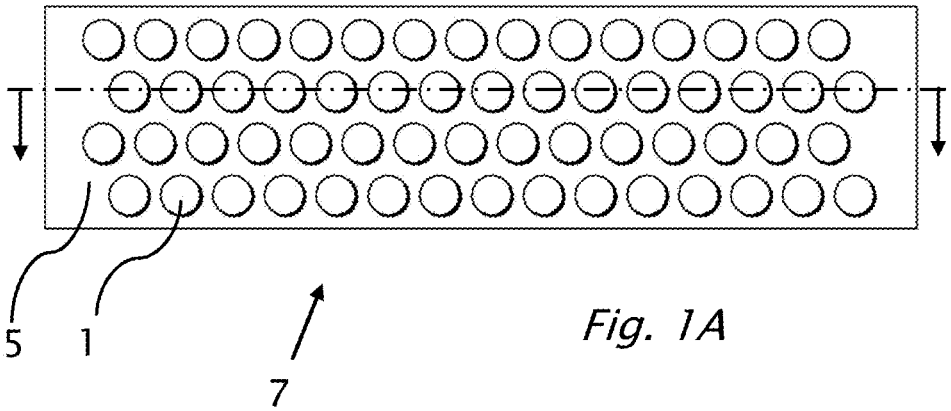
FIGS. 1A and 1B shows plan and cross sectional drawings respectively of an article of manufacture for protection of a wrist, according to an embodiment of the present invention.

Reference will now be made in detail to embodiments of the present invention, examples of which are illustrated in the accompanying drawings; wherein like reference numerals refer to the like elements throughout. The embodiments are described below to explain the present invention by referring to the figures.

Figure 1B:
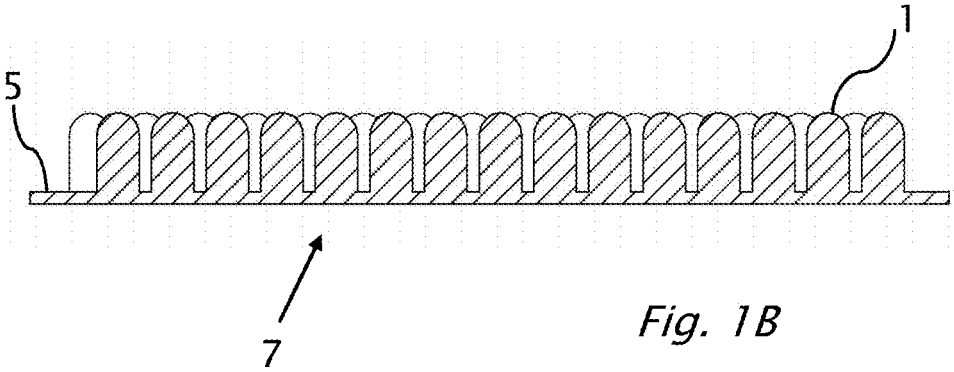
Figure 1C:
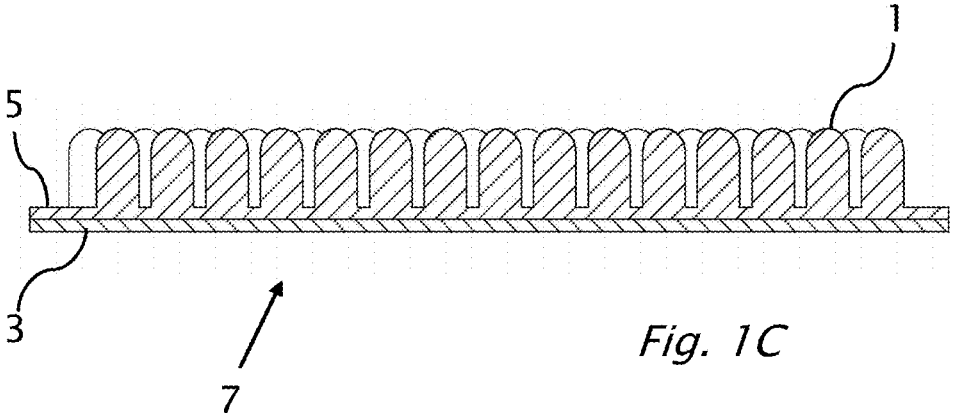
FIG. 1C is a cross sectional view of the article of manufacture for protection of the wrist as a flat mat on a work surface, according to an embodiment of the present invention.

Referring now to the drawings, FIGS. 1A and 1B illustrate in plan (top view) and cross section of a single casting or other manufacture, e.g. injection molding of structure 7 of an elastic material, e.g. silicone rubber. Structure 7, is, for example, a strip, to be used for protection of a wrist. The structure has protrusions 1 attached to a sheet 5. Reference is now also made to FIG. 1C which illustrates sheet 5 is attached to a backing 3. The material properties for the protrusions 1, sheet 5 and backing 3 are selected according to the requirements of the utilization of structure 7.

Any casting method, e.g. injection molding, known in the art of polymer industrial processes may be used to form structure 7.

Figure 2:
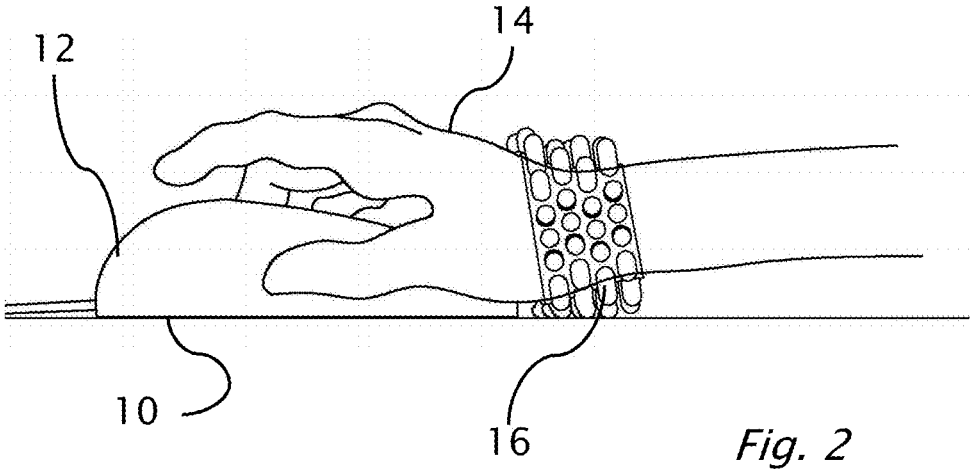
FIG. 2 is illustrates the article of manufacture of FIG. 1 being used as a wristband, according to an embodiment of the present invention.

Reference is now made to FIG. 2 which illustrates structure 7 in a preferred embodiment of the present invention being utilized as a wristband 16. A hand 14 is shown using a computer mouse 12 on a work surface 10. Backing 3 is preferably of canvas or similar textile material or another polymeric layer to provide comfort to the wearer of wristband 16.

Figure 3:
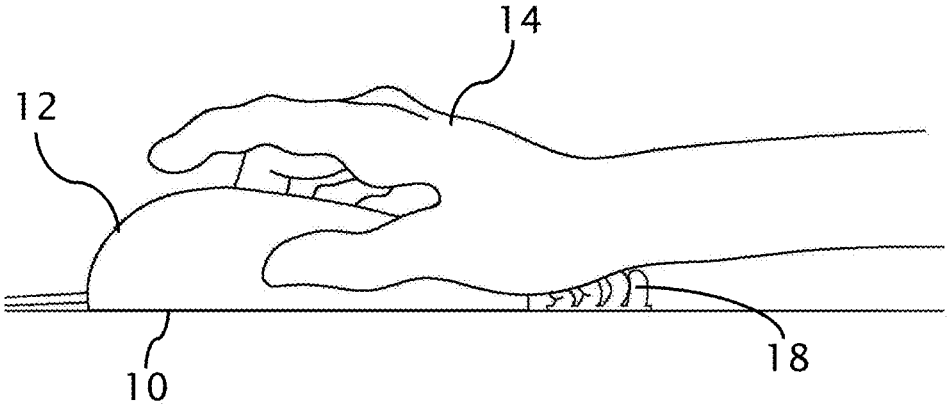
FIG. 3 is a diagram showing the article of manufacture being used as a flat mat placed on the work surface with protrusions facing upward, according to an embodiment of the present invention.

Reference is now also made to FIG. 3 which illustrates another preferred embodiment of the present invention in which structure 7 is utilized as a mat 18 with protrusions 1 facing upwards. Hand 14 is shown using mouse 12 on work surface 10. Wrist/hand 14 is shown resting on protrusions 1, in this situation the dimensions and undeformed shape of protrusions 1 are selected to provide comfort to the user of mat 18. Optionally, a coating is applied to the top surfaces of protrusions 1 to provide additional comfort, i.e. the coating absorbs or dissipates sweat from the skin of the wrist. Backing 3 is optionally rubber to prevent the slipping of mat 18 or backing 3 is a canvas type of material which allows the movement of mat 18. In other embodiments of the invention wristband 16 is closed with protrusions 1 facing inward toward the wrist instead of outward.

Figure 4:
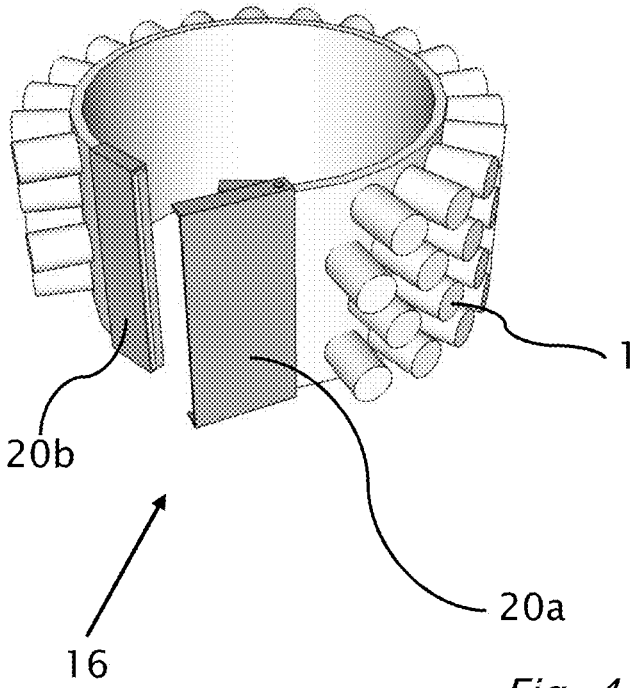
FIG. 4 is an isometric drawing illustrating the article of manufacture as a wristband, according to an embodiment of the present invention.
Figure 5:
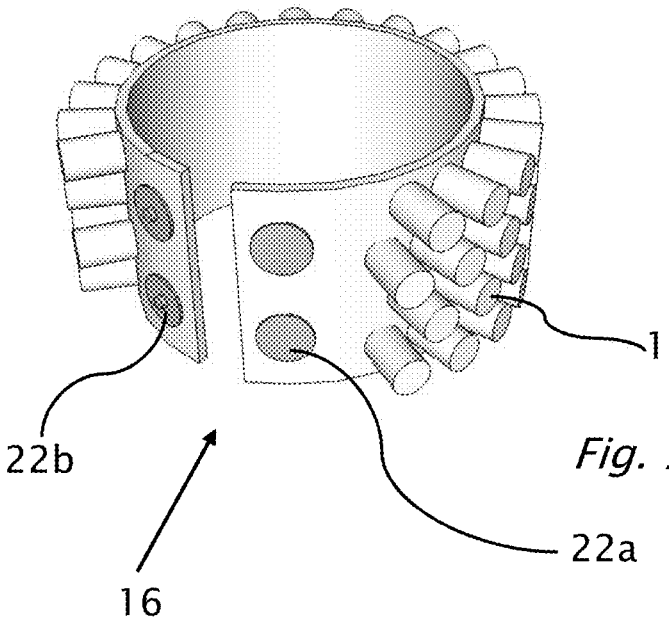
FIG. 5 is an isometric drawing illustrating the article of manufacture as a wristband, according to another embodiment of the present invention.

FIGS. 4 and 5 show two different closure devices which form fasteners of wristband 16, according to different embodiments of the present invention. FIG. 4 shows the ends of wristband 16 being connected together by a clasp device, e.g. Velcro 20*a* and 20*b*. FIG. 5 shows the ends of wristband 16 being connected together by a press stud 22*a* and 22*b*. Alternatively the ends of wristband 16 are connected together using any other method known in the art of fastening.

Figure 6:
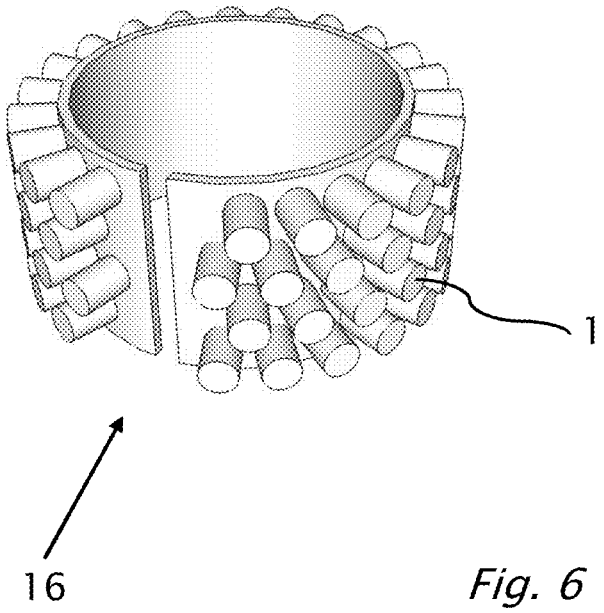
FIG. 6 is an isometric drawing illustrating the article of manufacture as a wristband, according to yet another embodiment of the present invention.
Figure 7:
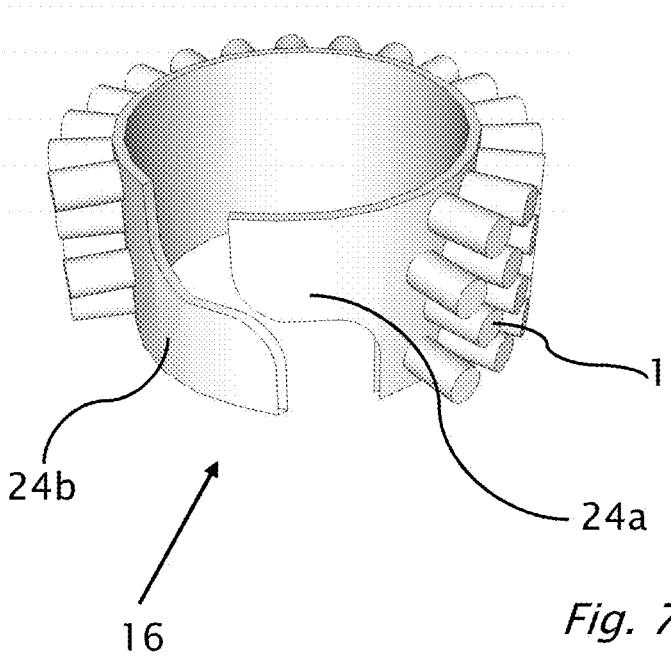
FIG. 7 is still another isometric drawing illustrating the article of manufacture as a wristband, according to another embodiment of the present invention.
Figure 8:
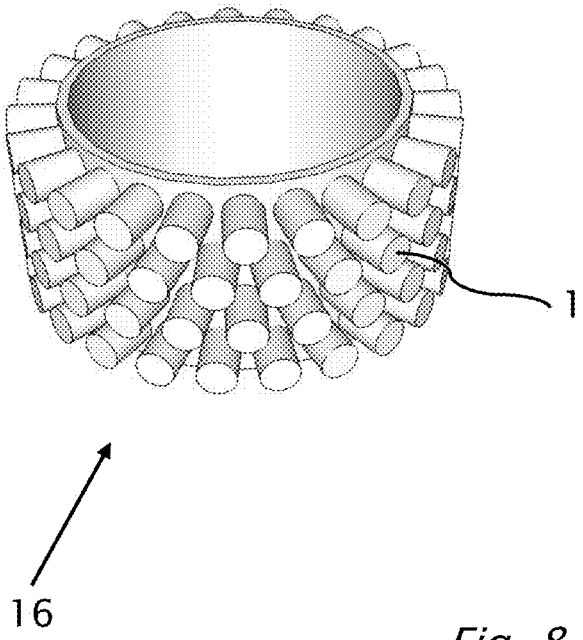
FIG. 8 is an isometric drawing illustrating the article of manufacture as a wristband, according to another embodiment of the present invention.

Reference is now made to FIGS. 6-8 which illustrates further embodiments of wristband 16, according to different aspects of the present invention. FIG. 6 illustrates an embodiment of wristband 16 in which sheet 5 and optionally backing 3 are semi-rigid so that hand 14 may be inserted into the wristband while elastically deforming sheet 5 and that after inserting hand 14, wristband 16 elastically returns to its undeformed state and closes around the wrist. The term "lateral" as used herein in reference to wristband 16 refers to a direction which crosses the width of the band in a direction parallel to the axis of rotational symmetry of the band. Wristband 16 of FIG. 6 is cut substantially in the lateral direction so that while hand 14 is being inserted wristband 16 deforms elastically by opening the lateral cut. The term "radial" as used herein in reference to wristband 16 refers to a direction perpendicular to the axis of rotational symmetry of the wristband. The term "circumferential" as used herein in reference to wristband 16 refers to a direction perpendicular a radius of wristband 16 and tangential to wristband 16. The terms "outward" and "inward" refer to directions substantially perpendicular to a tangent to the circumference of the wristband. FIG. 7 illustrates an embodiment of wristband 16 in which sheet 5 and optionally backing 3 are typically more elastic (less rigid) than that of FIG. 6. Closure of wristband 16 is achieved by including in edge contours 24*a* and 24*b* significant circumferential portions. The circumferential portions of edge contours 24*a* and 24*b* allow a significant elastic distortion in the radial direction, i.e. opening the wristband, without having a large space in the band which would allow wristband 16 to fall sideways off the wrist. A similar effect is achieved if edge contours are straight but with a significant circumferential component. FIG. 8 is an example of wristband 16 which is fully closed but is sufficiently elastic to allow deformation for inserting the hand through the band. In all embodiments, edge contours 24 are either cut from a subsequent to injection molding or are molded with the edge contours during the molding process.

Figure 9:
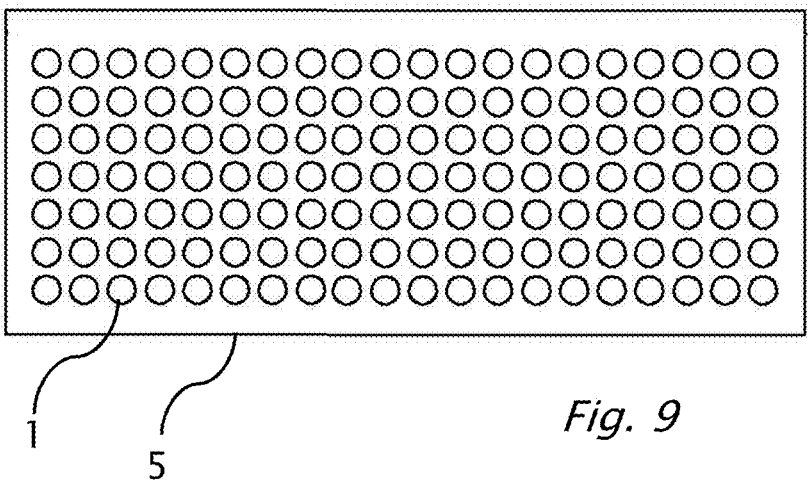
FIGS. 9-11 illustrate different examples of lateral distribution of the protrusions which may be used in different embodiments of the present invention.
Figure 10:
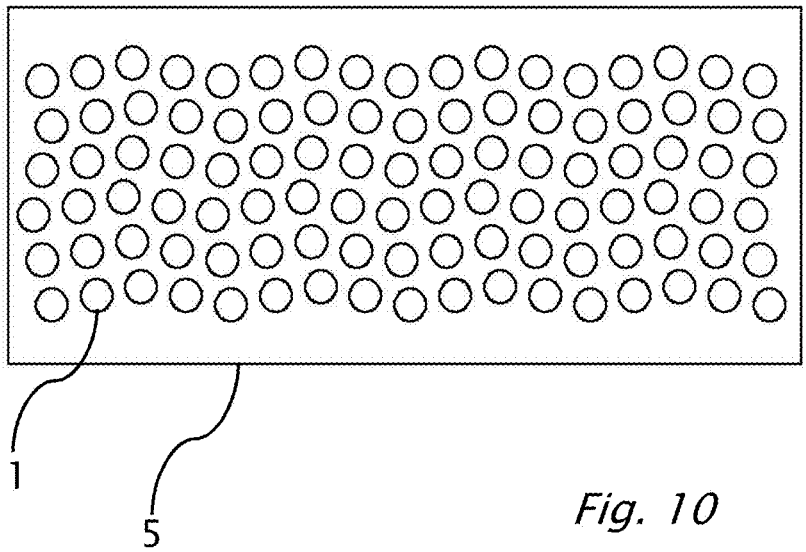
Figure 11:
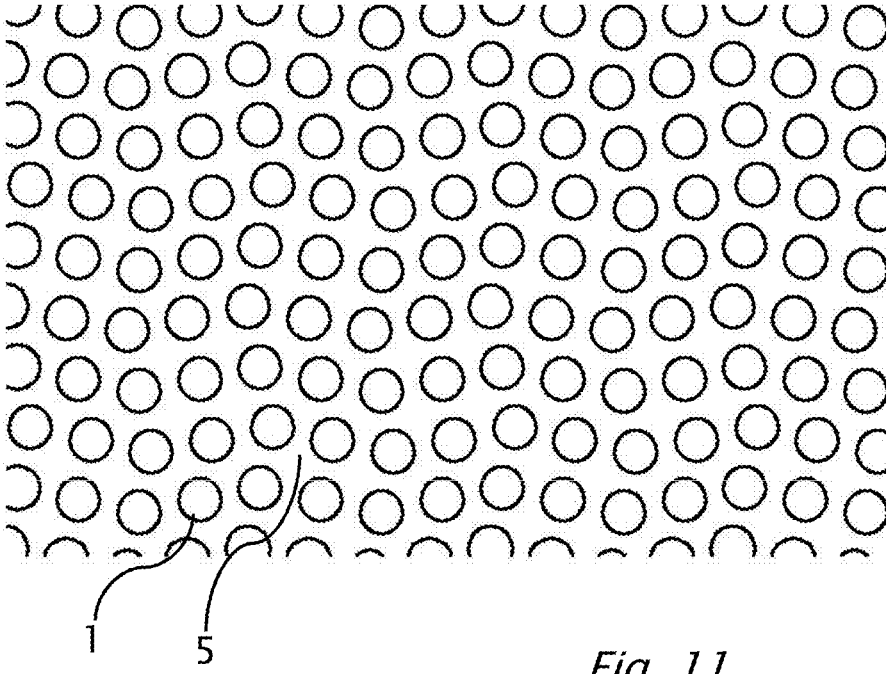

Reference is now made to FIG. 9-11 which illustrate exemplary distributions in top view of protrusions 1 manufactured preferably in a single casting on sheet 5, according to different aspects of the present invention. FIG. 9 illustrates protrusions distributed in an ordered lattice of rows and columns. Although the lattice constants (distances between rows and columns) in both lateral directions are shown as equal, the present invention in other embodiments may be configured to have distances between rows different from the distances between columns. Similarly, lattice angles may be configured to be angles other than ninety degrees as shown the example of FIG. 9. Reference is now made to FIGS. 10 and 11 which illustrate distributions of reduced order of protrusions 1 on sheet 5. In FIGS. 9 and 10 rows and columns are not necessarily straight but follow a predictable or random curve. The example of FIG. 10 includes another aspect of borders which are not defined, order does not increase at the borders. Other features not explicitly illustrated may be used according to other features of the present invention. The cross sectional area of protrusions 1 may vary from row to row or column to column or even vary randomly throughout the distribution. Lattice angles may also be varied within the distribution.

Figure 12:
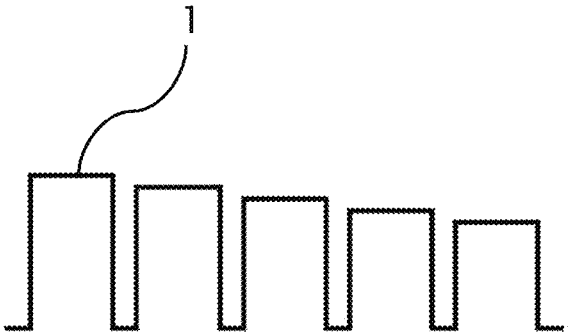
FIG. 12 illustrates varying heights of protrusions, according to an embodiment of the present invention.
Figure 13:
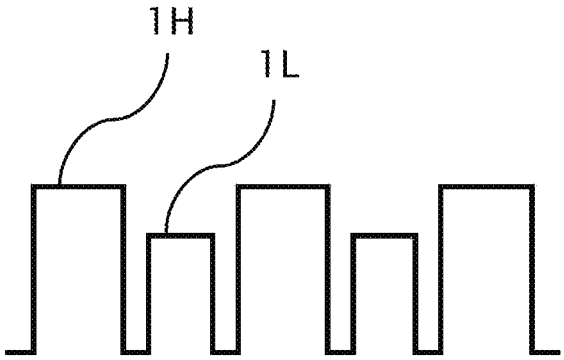
FIG. 13 illustrates protrusions of two different heights and/or lateral dimension according to an embodiment of the present invention.

Reference is now made FIGS. 12 and 13 which illustrate another aspect of the present invention. Specifically, in FIG. 12, heights of protrusions 1 vary monotonically along one or more lateral directions. The monotonic variation may be suited to the angle of the wrist and/or contour of the wrist while wristband 16 and/or mat 18 is in use. FIG. 13 illustrates a periodic size (height and lateral dimension variation) along one or more lateral directions. A periodic height variation is preferably combined with another periodically varying parameter such as a periodically varying cross section of protrusion 1 along a lateral direction.

Figure 14:
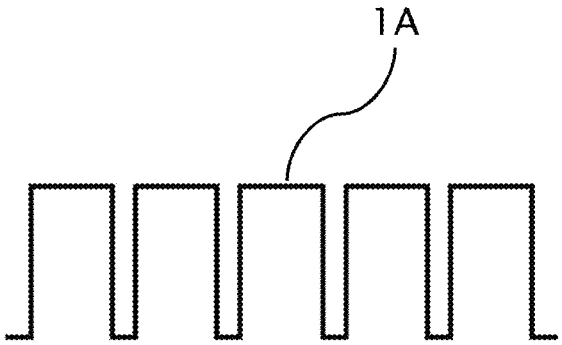
FIGS. 14-19 illustrate different examples cross sections of the protrusions, according to different embodiments of the present invention.
Figure 15:
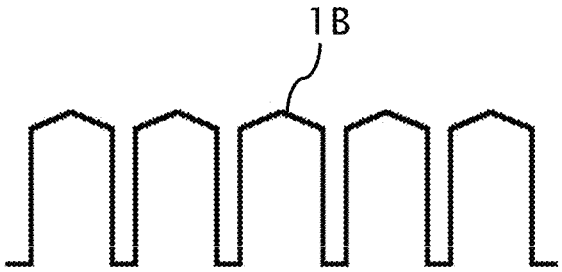
Figure 16:
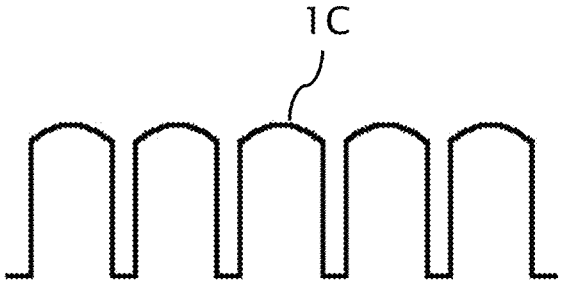
Figure 17:
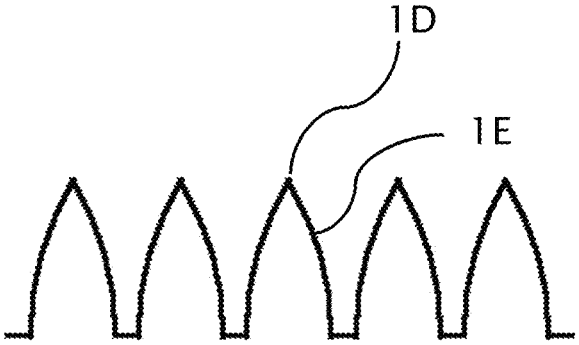
Figure 18:
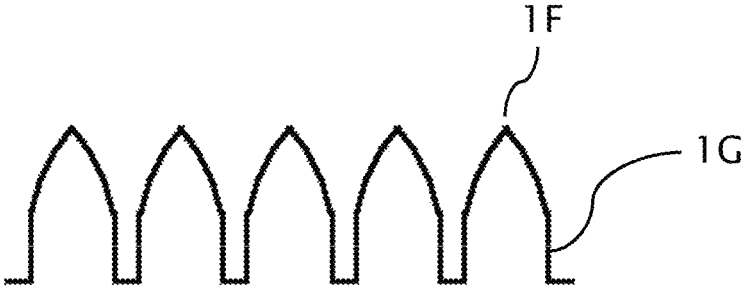
Figure 19:
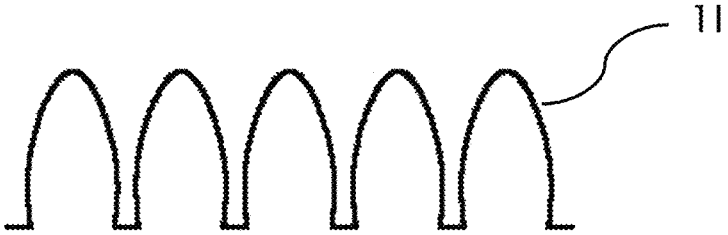

Reference is now made to FIGS. 14-19 which illustrate schematically in front view different example profiles of of protrusions 1. FIG. 14 illustrates a profile 1A of a right angle prism or right circular cylinder with a flat top. FIG. 15 illustrates a a profile of a right angle prism or right circular cylinder with a pointed top. FIG. 15 illustrates a a profile 1B of a right angle prism or right circular cylinder with a pointed top. FIG. 15 illustrates a a profile 1C of a right angle prism or right circular cylinder with a rounded top. FIG. 16 illustrates a a profile 1C of a right angle prism or right circular cylinder with a rounded top. FIG. 17 illustrates a profile 1D which includes a cone shaped bottom portion 1E. FIG. 18 illustrates a profile 1F which in the bottom part is a right angled prism or cylinder 1G and in the top part not right angled, for instance portions of cones, paraboloids or ellipsoids. FIG. 19 illustrates a profile 1I which is ellipsoid or paraboloid.

The present invention in different embodiments may be realized using a number of elastomeric thermoset or thermoplastic polymers including:

Unsaturated rubbers that can be cured by sulfur vulcanization such as Natural Rubber (NR), Synthetic Polyisobutylene (IR), Butyl rubber (copolymer of isobutylene and isoprene, IIR), Halogenated butyl rubbers (Chloro Butyl Rubber: CIIR; Bromo Butyl Rubber: BIIR), Polybutadiene (BR), Styrene-butadiene Rubber (copolymer of polystyrene and polybutadiene, SBR), Nitrile Rubber (copolymer of polybutadiene and acrylonitrile, NBR), also called Buna N rubbers, Hydrogenated Nitrile Rubbers (HNBR) Therban and Zetpol, Chloroprene Rubber (CR), polychloroprene, Neoprene, Baypren etc. Unsaturated rubbers can also be cured by non-sulfur vulcanization if desired.

Saturated Rubbers that cannot be cured by sulfur vulcanization include: EPM (ethylene propylene rubber, a copolymer of ethylene and propylene) and EPDM rubber (ethylene propylene diene rubber, a terpolymer of ethylene, propylene and a diene-component). Epichlorohydrin rubber (ECO), Polyacrylic rubber (ACM, ABR), Silicone rubber (SI, Q, VMQ), Fluorosilicone Rubber (FVMQ), Fluoroelastomers (FKM, and FEPM) Viton, Tecnoflon, Fluorel, Aflas and Dai-El, Perfluoroelastomers (FFKM) Tecnoflon PFR, Kalrez, Chemraz, Perlast, Polyether Block Amides (PEBA) Chlorosulfonated Polyethylene (CSM), (Hypalon), Ethylene-vinyl acetate (EVA); and Various other types of elastomers: Thermoplastic elastomers (TPE), for example Elastron, etc., Thermoplastic Vulcanizates (TPV), for example Santoprene TPV, Thermoplastic Polyurethane (TPU), Thermoplastic Olefins (TPO), and the proteins resilin and elastin and Polysulfide Rubber Preferred physical characteristics for the cast material are Shore A hardness in the range 10-70

A casting was produced according to the embodiment of FIG. 1 using a two component silicone elastomer S-471 (ESQUIM S.A., Barcelona, Spain) The inventor who suffers from carpal tunnel syndrome tested the prototype and found that the elastic protrusions alleviated discomfort.

While the invention has been described with respect to a limited number of embodiments, it will be appreciated that many variations, modifications and other applications of the invention may be made.

What is claimed is:

1. A method for wrist support comprising:

providing a strip comprising:

a sheet of a Shore A hardness of at least 10 with oppositely disposed ends; and, a plurality of elastic protrusions extending from the sheet in a longitudinal dimension, each of the protrusions of a lateral dimension of a diameter of approximately 2 mm to 10 mm, the lateral dimension at least substantially perpendicular to the longitudinal dimension, and in an arrangement with the other protrusions to cooperatively support a wrist by providing a resistive force proximate to the corresponding location of the strip where pressure is applied by the wrist, the protrusions of a material less stiff than the material of the sheet; and, placing the strip in communication with a surface, such that when pressure is applied to the strip from the wrist, the protrusions, proximate to the location of the pressure on the strip, cooperate to provide a resistive force for supporting the wrist.

2. The method of claim 1, further comprising: removing the strip from the work surface and wearing the strip as a band on the wrist.

3. The method of claim 2, wherein the wearing the strip as a band on the wrist includes orienting the strip such that the protrusions face the wrist.

4. The method of claim 2, further comprising: connecting together ends of said band with a fastening device.

5. The method of claim 2, wherein the protrusions are cylindrical in shape.

6. The method of claim 2, wherein the ends of the protrusions extending from the sheet define a surface of the strip, the surface including a contour, being at least one of: 1) an incline, and, 2) periodic elevational variations.

7. The method of claim 2, wherein the wearing the strip as a band on the wrist includes orienting the strip such that the sheet faces the wrist.

8. The method of claim 1, wherein the placing the strip in communication with a surface includes placing the strip in contact with the surface and orienting the strip such that sheet faces the surface.

9. The method of claim 1, wherein the placing the strip in communication with a surface includes placing the strip in contact with the surface and orienting the strip such that the protrusions face the surface.

10. The method of claim 1, wherein the material of the protrusions is of a Shore A hardness of approximately 10-70.

11. The method of claim 1, wherein the protrusions, proximate to the location of the pressure on the strip, are spaced apart with respect to each other to cooperate to provide a resistive force for supporting the wrist, by deforming elastically and multidirectionally, the deforming elastically including bending about a longitudinal axis parallel to the longitudinal dimension of which the protrusions extend from the sheet.

12. A method for wrist support comprising:

providing a wrist band comprising:

1) a sheet of a Shore A hardness of at least 10 with oppositely disposed ends, and, 2) a plurality of elastic protrusions extending from the sheet in a longitudinal dimension, each of the protrusions of a lateral dimension of a diameter of approximately 2 mm to 10 mm, the lateral dimension at least substantially perpendicular to the longitudinal dimension, and in an arrangement with the other protrusions to cooperatively support a wrist by providing a resistive force proximate to the corresponding location of the wrist band where pressure is applied by the wrist, the protrusions of a material less stiff than the material of the sheet;

placing the wrist band on the wrist by moving the oppositely disposed ends into communication with each other in a joined manner around the wrist; and, upon contact with a surface coupled with pressure from the wrist, the protrusions, proximate to the location of the pressure on the wrist band, cooperate to provide a resistive force for supporting the wrist.

13. The method of claim 12, wherein said material of said sheet and said material of said protrusions includes a single material.

14. The method of claim 12, wherein said material of said sheet includes a woven textile matrix.

15. The method of claim 12, wherein said material of said sheet includes a synthetic textile matrix.

16. The method of claim 12, wherein said material of said protrusions is an elastomer.

17. The method of claim 12, wherein said material of said protrusions is at least one of silicone rubber, latex rubber or natural rubber.

18. The method of claim 12, wherein the protrusions are oriented to face toward the wrist.

19. The method of claim 12, wherein the protrusions are cylindrical in shape.

20. The method of claim 12, wherein the ends of the protrusions extending from the sheet define a surface of the wristband, the surface including a contour being at least one of: 1) an incline, and, 2) periodic elevational variations.

21. The method of claim 12, wherein the sheet is oriented to face toward the wrist.

* * * * *